US005592027A

United States Patent [19]

Jacq et al.

[11] Patent Number: 5,592,027

[45] Date of Patent: Jan. 7, 1997

[54] COMPACTING FLAMMABLE AND/OR EXPLOSIVE METAL WASTE

[75] Inventors: Patrick Jacq, Montigny le Bretonneux; Jean C. Masse, Jouy en Josas; Isabelle Morlaes, Clamart, all of France

[73] Assignee: Compagnie Générale Des Matiéres Nucléaires, Velizy-Villacoublay, France

[21] Appl. No.: 481,297

[22] PCT Filed: Jan. 14, 1994

[86] PCT No.: PCT/FR94/00045

§ 371 Date: Jun. 28, 1995

§ 102(e) Date: Jun. 28, 1995

[87] PCT Pub. No.: WO94/15775

PCT Pub. Date: Jul. 21, 1994

[30] Foreign Application Priority Data

Jan. 14, 1993 [FR] France ..... 93 00279

[51] Int. Cl.[6] ..... G21C 21/00

[52] U.S. Cl. ..... 264/0.5; 588/2; 588/16

[58] Field of Search ..... 264/0.5; 588/2, 588/16

[56] References Cited

U.S. PATENT DOCUMENTS

| | | | |
|---|---|---|---|
| 4,065,299 | 12/1977 | Roberts et al. . | |
| 4,654,171 | 3/1987 | Boncoeur et al. | 252/626 |
| 4,834,917 | 5/1989 | Kamm et al. | 252/633 |
| 5,045,241 | 9/1991 | Kuriyama et al. | 252/628 |
| 5,063,001 | 11/1991 | Miyao et al. | 264/0.5 |
| 5,205,966 | 4/1993 | Elmaleh | 252/626 |
| 5,248,453 | 9/1993 | Kamm | 252/629 |

FOREIGN PATENT DOCUMENTS

| | | | |
|---|---|---|---|
| 0081074 | 6/1983 | Germany | G21F 9/34 |
| 3314521 | 10/1984 | Germany | B30B 9/30 |

OTHER PUBLICATIONS

International Search report for corresponding International Application No. PCT/FR 94/00045, dated Apr. 7, 1994.

Patent Abstracts of Japan; vol. 5, No. 162, p. 92, Oct. 17, 1981.

*Primary Examiner*—Ngoclan Mai

*Attorney, Agent, or Firm*—Cohen, Pontani, Lieberman, Pavane

[57] ABSTRACT

A method of compacting, without danger of ignition and/or explosion, metal waste that is liable to ignite and/or explode while being compacted. The method comprises in compacting a container that contains said waste and that is saturated in inert gas.

11 Claims, 1 Drawing Sheet

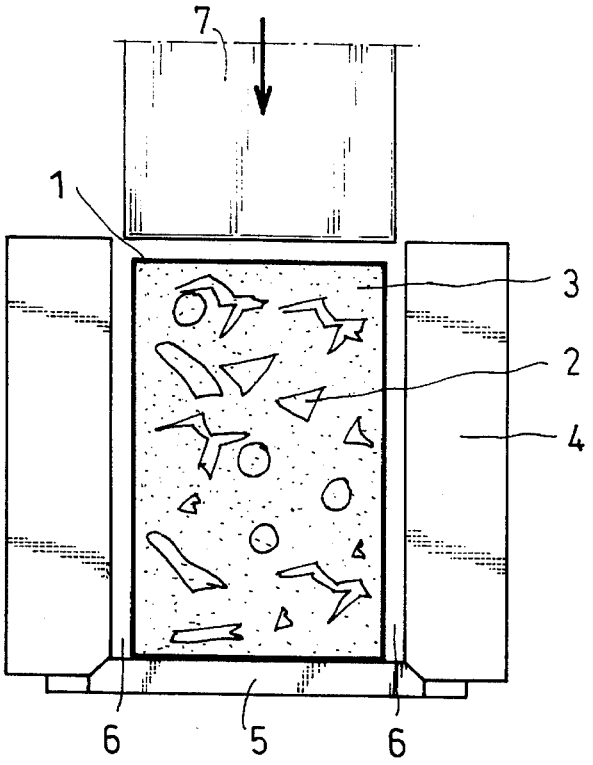
FIG_1
FIG_2
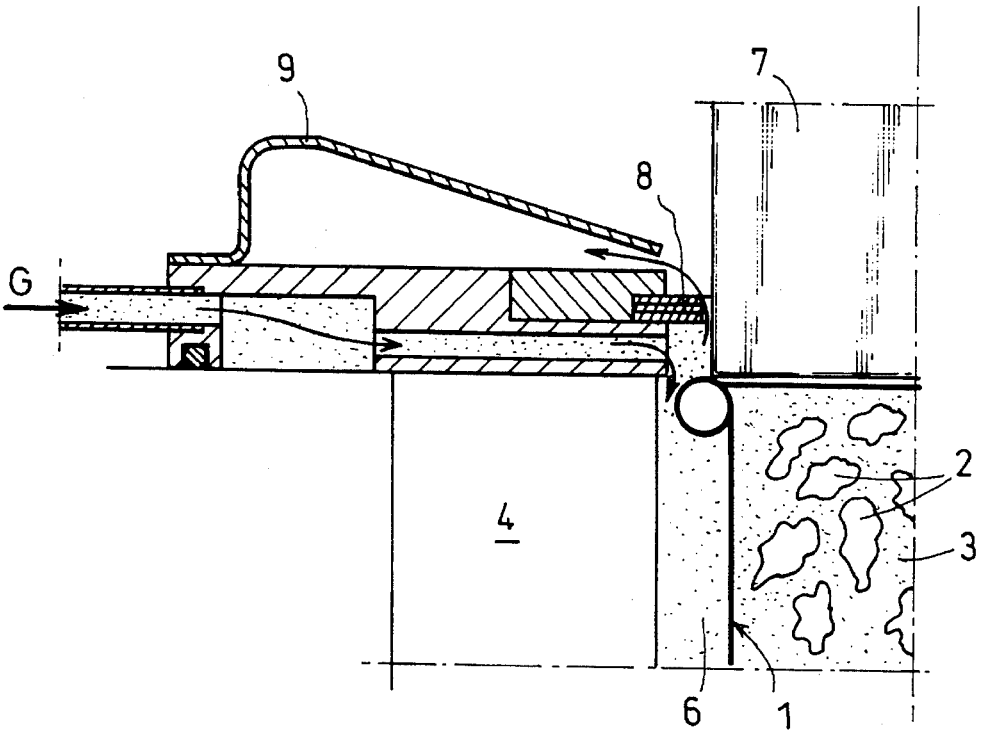

COMPACTING FLAMMABLE AND/OR EXPLOSIVE METAL WASTE

BACKGROUND OF THE INVENTION

1. Field of the Invention

The present invention relates to a method of compacting, without danger of ignition and/or explosion, metal waste that is liable to ignite and/or explode when compacted in a conventional manner.

Said method is advantageously implemented during treatment of irradiated metal waste, in particular containing zirconium and/or magnesium and/or alloys of said metals. The method is described in greater detail below with reference to this nuclear context, however that does not imply any limitation on its implementation in other contexts. The person skilled in the art will readily understand on reading the text below that the principle of the invention, i.e. internal blanketing, is transposable to numerous fields.

2. Description of the Related Art

The invention proposes a solution to the general problem of compacting waste of pyrophoric tendency.

Such waste is generated, in particular, during retreatment of irradiated nuclear fuel elements. Thus, for example, the shearing of said elements generates both fuel in solution and pieces of tube or "hulls", generally made of zircalloy. At present, said hulls are washed and placed in drums. Said drums are then embedded in cement without being reduced in volume. The same applies to storing other materials, and in particular other structural elements for said fuels, such as grids and endpieces, to storing magnesium. The invention seeks to optimize the final storage volume; to reduce the size of said drums.

Compacting such drums nevertheless poses a problem in that firstly said drums contain oxygen and fines, and secondly compacting makes use of energy that is liable to cause said fines to react violently. There therefore exists a danger of such drums exploding and/or igniting during compacting. The invention proposes reducing and controlling, or even eliminating this danger.

SUMMARY OF THE INVENTION

The compacting method of the invention thus makes it possible, without danger of ignition and/or explosion to apply compression to reducing the volume of metal waste that is nevertheless liable to ignite and/or explode if subjected to such compression in a conventional manner.

Said method of the invention consists in exerting said compression on a container that contains said waste and that is saturated in inert gas.

As mentioned above, internal blanketing is performed so that during compacting the waste remains continuously under an inert atmosphere.

Said blanketing makes use of an inert gas. Solid or liquid blanketing is excluded because of the large quantities of inert materials required and because of the incompressibility of such materials.

The method of the invention may be implemented as follows.

The waste is loaded in bulk into a suitable container. During loading, an inert gas is injected into said container by bubbling so as to fill the voids generated by the expansion of said waste in said container with an inert atmosphere: both voids between pieces of waste and voids between waste and the walls of the container. Air, and thus oxygen, is expelled from said container in this way. Said container is saturated in inert gas. In theory, excess pressure is not generated inside said container since it is not useful. Said container is loaded under atmospheric pressure.

The container loaded in this way is fitted with a cover. It is necessary to ensure that such a cover is sealed only if the inert gas used is lighter than air.

Said container, once loaded and optionally sealed (hermetically plugged) is then inserted in a compacting skirt to be compacted therein under drive from a piston.

The diameter of the compacting skirt is naturally adapted to the dimensions of the container to be compacted. A limited amount of clearance—a few millimeters—is provided between said container and said skirt. The piston whose diameter is also adapted to the diameter of said skirt in application of the usual principles of press design then compresses said container, the waste, and the inert gas present inside the container.

Once the pressure exerted reaches a certain threshold, the inert gas escapes through cracks generated in the walls of said container and then fills the clearance—the residual space—between said container and said compacting skirt. The waste is thus continuously blanketed.

It is appropriate for said container to crack by kinking under the compression drive exerted by the piston rather than under the action of excess pressure generated inside said container. To this end, an appropriate container is selected as a function of the design compacting pressure (in turn related to the nature of the waste to be compacted and of the desired reduction in volume). Two parameters are available for such optimization: the nature of the material constituting said container and its thickness.

In implementing the method of the invention, it is possible to provide additional blanketing by injecting inert gas—advantageously the same as the gas that was injected into the container, and in any event a gas that is heavier than air—around the container into the clearance between said container and the compacting skirt, before beginning the compacting operation. This additional blanketing is necessary only when the volume of inert gas present in the container is much too small to fill the clearance between said container and said compacting skirt.

The inert gas(es) used in the method of the invention are advantageously selected from argon and nitrogen. It is also possible to use other inert gases. In any event, the selection of the gas is associated with the type of pyrophoricity of the waste to be compacted.

The person skilled in the art will readily understand that if argon is used for filling the container, then it is superfluous to provide sealing at its cover. If nitrogen is used for this purpose, sealing of such a cover can be omitted if, and only if, compacting is implemented quickly after said loading.

The method of the invention—internal blanketing plus optional external blanketing—eliminates any danger of ignition and/or explosion during compacting of substances of pyrophoric tendency.

Naturally, said method is implemented after taking the usual elementary precautions. It is always advisable to limit the provision of oxidizer (e.g. water which is reduced by prior drying of the waste), the provision of fuel (fines, where steps are taken to limit creation and dispersion thereof by reducing compacting speed) and provision of energy (likewise associated with compacting speed).

As explained above, the method of the invention can be implemented, in particular, for compacting radioactive metal waste such as waste containing zirconium and/or magnesium and/or alloys of said metals. It is advantageously used for compacting zircalloy hulls.

In this context, it will be understood that the invention is implemented in nuclear surroundings: inside a cell and by remote control.

BRIEF DESCRIPTION OF THE DRAWINGS

The invention is illustrated in the figures accompanying the present description.

FIG. 1 is a longitudinal section through compacting apparatus for implementing the method of the invention (internal blanketing); and FIG. 2 is a diagram showing a detail of the top portion of a compacting apparatus for implementing the method of the invention (internal and external blanketing).

In these two figures, the same references designate the same objects.

DETAILED DESCRIPTION OF THE PREFERRED EMBODIMENTS

The container to be compacted is referenced 1. It has previously been filled with waste 2 and saturated in inert gas 3, and then placed inside the compacting skirt 4 on the anvil 5. Said anvil 5 is a massive part placed on the bottom Jaw of the press to receive the compacting forces.

The clearance between said container 1 and said compacting skirt 4 is referenced 6. This limited amount of clearance 6 is saturated with inert gas 3 as soon as the first cracks appear in the structure of the container 1 under the action of the pressure exerted by the piston 7.

In FIG. 2, the clearance 6 between the container 1 and the compacting skirt 4 is larger than in FIG. 1. To be absolutely sure that the clearance 6 is saturated with inert gas during compacting, provision is made to fill the clearance 6 with inert gas (G) prior to said compacting. Advantageously, said inert gas G is the same as the gas 3 inside the container 1. Reference 8 designates a gasket and 9 a collecting ring. By using these elements, dispersion of fines in the compacting cell is limited.

The invention is also illustrated by the following example.

Zircalloy hulls were compacted in accordance with the invention.

There must be no water in waste of this type in order to avoid hydrogen being given off. Unfortunately, once dried and a fortiori broken up into small pieces with the presence of fines, said hulls are liable to ignite, even without any particular addition of energy.

It is therefore essential to provide blanketing while compacting said dried hulls.

The hulls were dried in an appropriate device under an inert gas. They were then loaded (with nitrogen bubbling) into a stainless steel container having a capacity of about 90 liters. The outside diameter of said container was 390 mm, and its height was 800 mm. The thickness of the steel was about 1 mm. The volume of hulls loaded into said container was about 82 liters. The apparent relative density of the nitrogen and hull mixture was about 1 (the relative density of the metal itself is 6.2–6.6).

The container loaded in this way was transferred into the compacting cell. In an advantageous manner, a collecting ring was provided therein above the compacting skirt to collect the inert gas escaping through the cracks in the container during compacting.

The pressure exerted was about 200 MPa.

A compressed compact was obtained having a height of about 150 mm and a relative density of 4.1.

Provision is made for transferring and conditioning such a compact into a final storage container.

We claim:

1. A method of compacting, without danger of ignition and/or explosion, waste liable to ignite and/or explode when compacted, said method comprising:

loading a container with said waste;

injecting an inert gas into said container so that said container is saturated in said inert gas; and compacting the container, which has been loaded with the waste and injected with the inert gas, thereby causing the container to develop cracks and the inert gas to be released from the container through the cracks.

2. A method according to claim 1, further characterized in that:

said waste is loaded in bulk into said container while the inert gas is being injected therein in order to fill voids within said container between pieces of said waste and between said waste and said container; and in that after loading, said container is provided with a cover, that is optionally sealed, sealing being necessarily required only if the inert gas used is lighter than air; and said loaded and optionally sealed container is then inserted in a compacting skirt to be compacted therein under drive from a piston.

3. A method according to claim 2, characterized in that prior to compacting, an inert gas is injected around the container to replace air between said container and said compacting skirt with said inert gas.

4. A method according to claim 2, characterized in that the pressure exerted during compacting generates cracks in the structure of said container.

5. A method according to claim 2, characterized in that it is used for compacting radioactive metal waste containing, in particular, zirconium and/or magnesium and/or alloys of said metals.

6. A method according to claim 2, characterized in that argon and/or nitrogen is/are used as the inert gas.

7. A method according to claim 1, characterized in that the pressure exerted during compacting generates cracks in the structure of said container.

8. A method according to claim 1, characterized in that it is used for compacting radioactive metal waste containing, in particular, zirconium and/or magnesium and/or alloys of said metals.

9. A method according to claim 1, characterized in that argon and/or nitrogen is/are used as the inert gas.

10. A method according to claim 2, further characterized in that said inert gas is injected into the container under atmospheric pressure.

11. A method according to claim 10, further characterized in that said container develops cracks caused by kinking under the drive exerted by the piston, not by excess internal pressure within the container.

* * * * *